US005752298A

United States Patent [19]

Howell

[11] Patent Number: 5,752,298

[45] Date of Patent: May 19, 1998

[54] EARCUP TENSION ADJUSTMENT STRAP ASSEMBLY

[75] Inventor: Clarence F. Howell, Bridgton, Me.

[73] Assignee: Down East, Inc., Bridgton, Me.

[21] Appl. No.: 729,959

[22] Filed: Oct. 15, 1996

[51] Int. Cl.[6] ..... A42B 3/08

[52] U.S. Cl. ..... 24/585; 24/581; 2/418

[58] Field of Search ..... 24/580–586, 308, 24/311, 324, 633, 615, 616, 71 T, 71 SK, 71.1, 68 EE, 68 T, 68 B, 265 BC, 265 EC; 2/6.2, 442, 425, 420, 906, 909, 918

[56] References Cited

U.S. PATENT DOCUMENTS

| | | | |
|---|---|---|---|
| 1,786,943 | 12/1930 | Gammell | 24/585 X |
| 3,035,573 | 5/1962 | Morton, Jr. et al. | 24/581 X |
| 3,628,190 | 12/1971 | Molitoris | 2/418 |
| 4,727,630 | 3/1988 | Alan | 24/585 |
| 4,942,628 | 7/1990 | Freund | 2/420 X |
| 5,003,632 | 4/1991 | Claude | 2/422 |
| 5,079,780 | 1/1992 | Coombs et al. | 2/420 |
| 5,357,654 | 10/1994 | Hsing-Chi | 2/418 X |
| 5,579,563 | 12/1996 | Sim | 24/585 |
| 5,611,644 | 3/1997 | Lutz | 24/585 X |

*Primary Examiner*—James R. Brittain
*Assistant Examiner*—Robert J. Sandy
*Attorney, Agent, or Firm*—Samuels, Gauthier, Stevens & Reppert

[57] ABSTRACT

A strap assembly for controlling the inward pressure on ear cups (14) mounted on a helmut (10). A rear strap (22) is rotatably secured to the helmut (10). At each end of the rear strap (22) are a pair of opposed buckles tabs (27). Each buckle defines a slot (36). The tabs (27) have a flexbile pawl (48) formed in a movable cover (44). There are a pair of opposed straps (60) having one end secured to the forward portion of the helmut. The other end of the strap (60) passes through the ear cups (14) and through the slots (36) in the buckle tabs. Each of the straps (60) has a ratchet track (64). When the straps (60) are moved toward one another to increase the inward pressure of the associated ear cups (14) the ratchet track slides under and displaces outwardly the pawl (48) in the tabs (27). Reversal movement of the strap (60) is prevented when the cover (44) is in its closed position.

3 Claims, 3 Drawing Sheets

EARCUP TENSION ADJUSTMENT STRAP ASSEMBLY

BACKGROUND AND BRIEF SUMMARY OF THE INVENTION

Crewmen operating armored military vehicles wear helmets to protect themselves from injury. Current designs secure the helmet with a chin-strap or a spring that squeezes the crewmen's head between the helmet's communication earcups. The chin-strap design is uncomfortable if worn for extended periods. The strap can also break the crewman's neck if the vehicle's cabin is struck and blast pressure forces the helmet off of the crewman's head. The spring design is not comfortable for extended periods because it is not possible for the crewman to conveniently adjust the inward pressure on earcups. The spring also does not exert a constant pressure over a range of head sizes and is difficult to install in the field.

With an adjustment strap assembly of the present invention, the earcup inward pressure is easily adjustable by the crewman. The earcups can be worn more loosely for maximum comfort or, if violent action is expected, the crewman can increase the inward pressure by simply pressing the earcups harder against the head. The adjustment assembly will automatically adjust and the increased earcup pressure is maintained until reduced by opening buckle tabs and releasing the straps.

The assembly accommodates all head sizes and shaped without the need for bending, adjusting and/or changing component parts.

The assembly is easy to install. The straps are threaded through slots in the helmet's struts and the base assembly is snapped onto the back of the helmet's shell. No tools are required.

DESCRIPTION OF THE PREFERRED EMBODIMENT(S)

Figure 1:
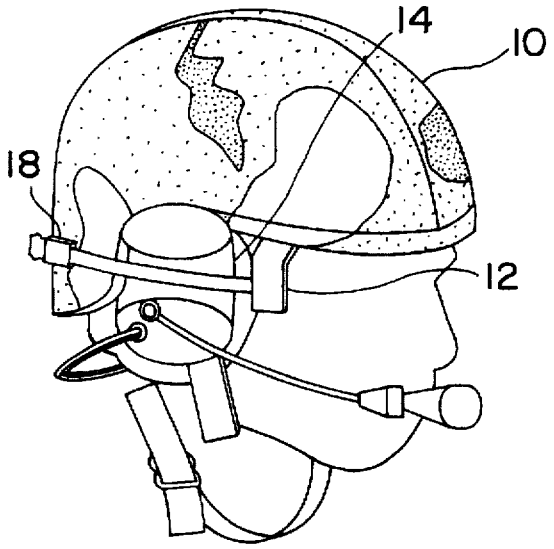
FIG. 1 is an illustration of a strap assembly of the invention in combination with a prior art helmet.

Referring to FIG. 1, a helmet is shown generally at 10 and comprises forward struts 12 (only right side shown), earcups 14 having a slot 16 formed on the outer surface thereof and on the rear of the helmet is one half of a snap assembly 18. The helmet, struts, earcup, the groove in the outer surface of the earcup and the one half of the snap assembly are prior art and need not be shown in detail. The strap assembly of the invention is shown generally at 20.

Figure 2:
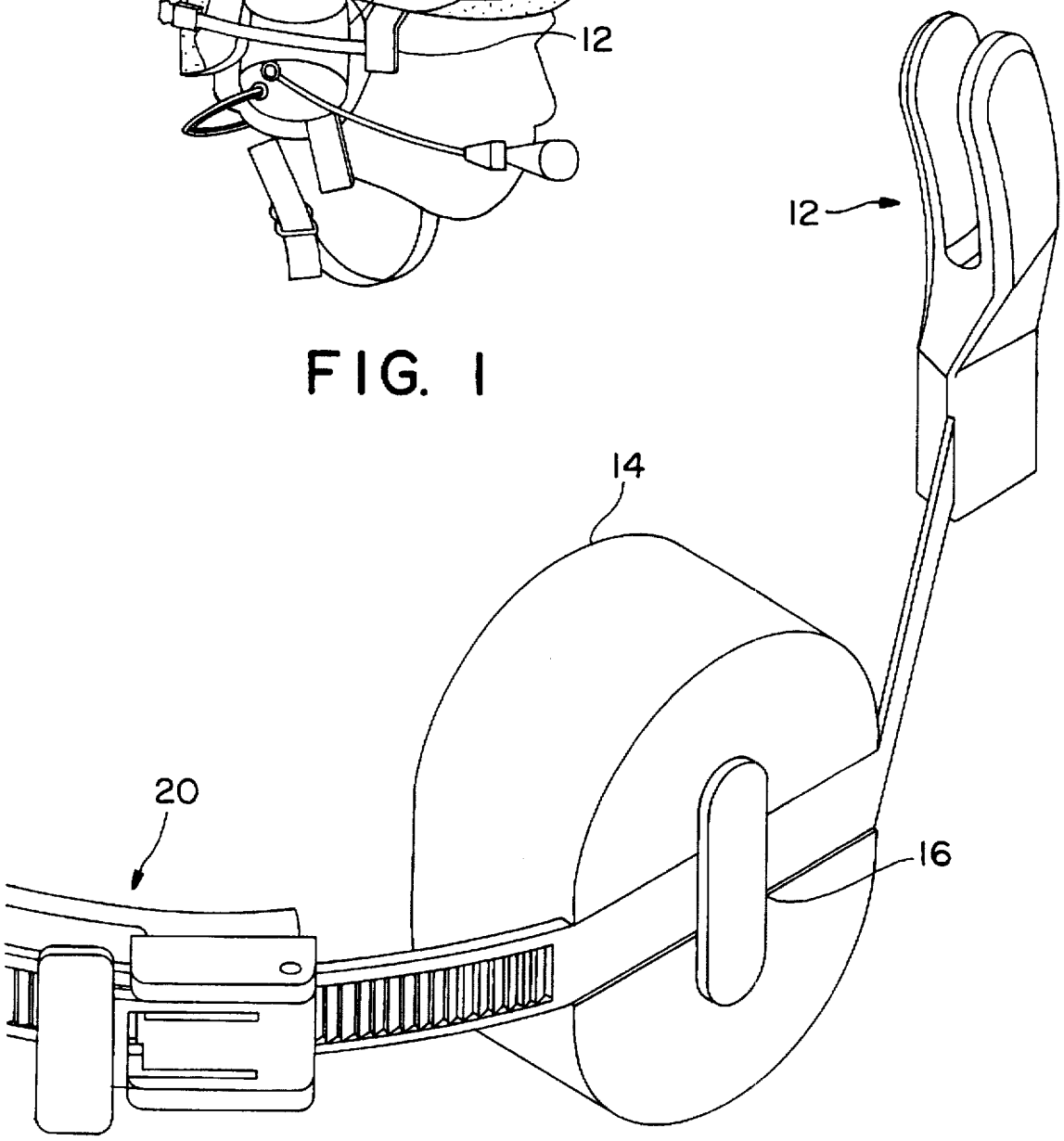
FIG. 2 is a partial perspective view of a strap assembly of the invention in combination with a prior art strut and ear piece.

FIG. 2 illustrates the attachment of the strap assembly 20 to the strut 12 and earcup 16.

Figure 3:
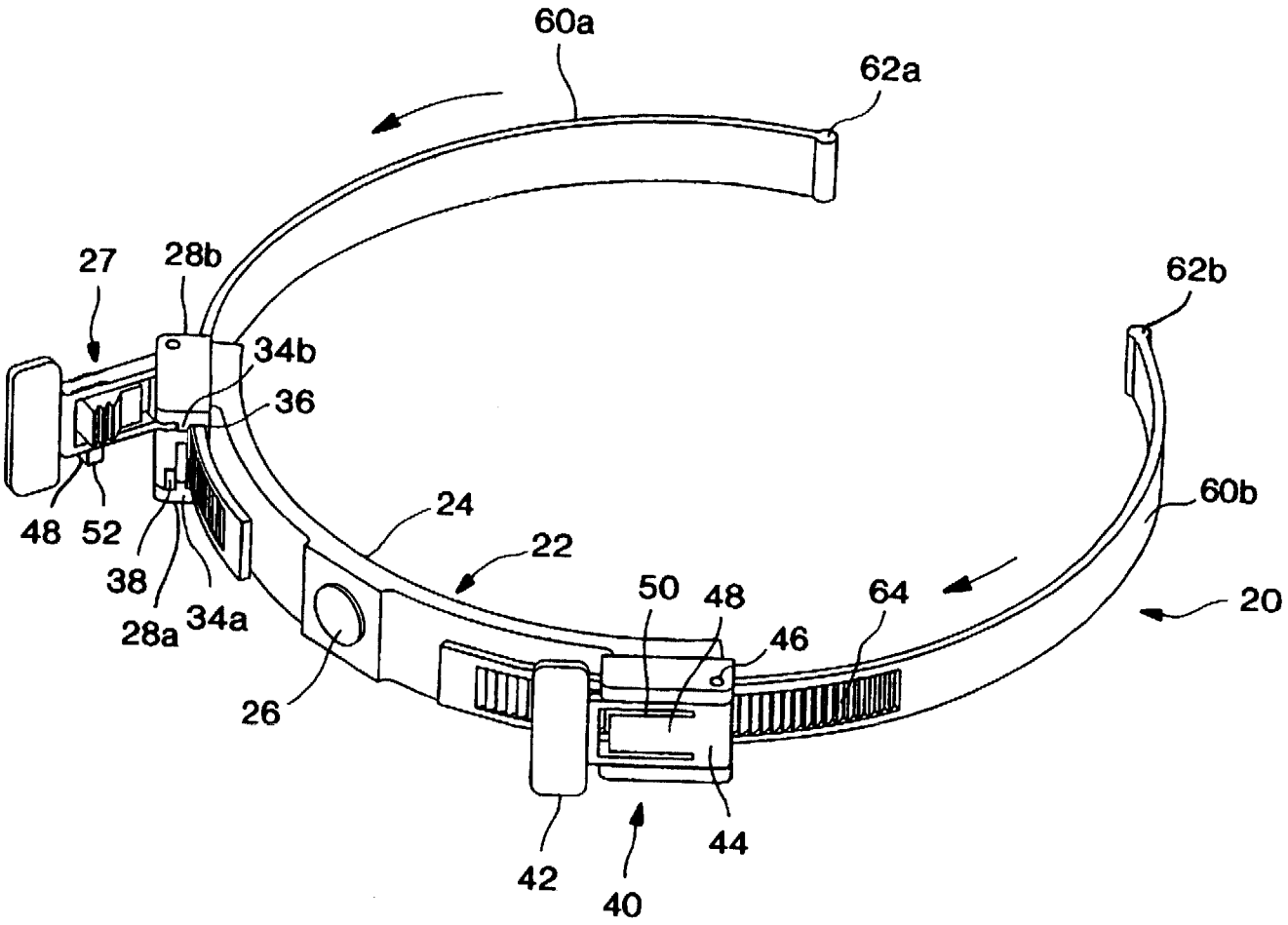
FIG. 3 is a perspective view of a strap assembly of the invention.
Figure 4:
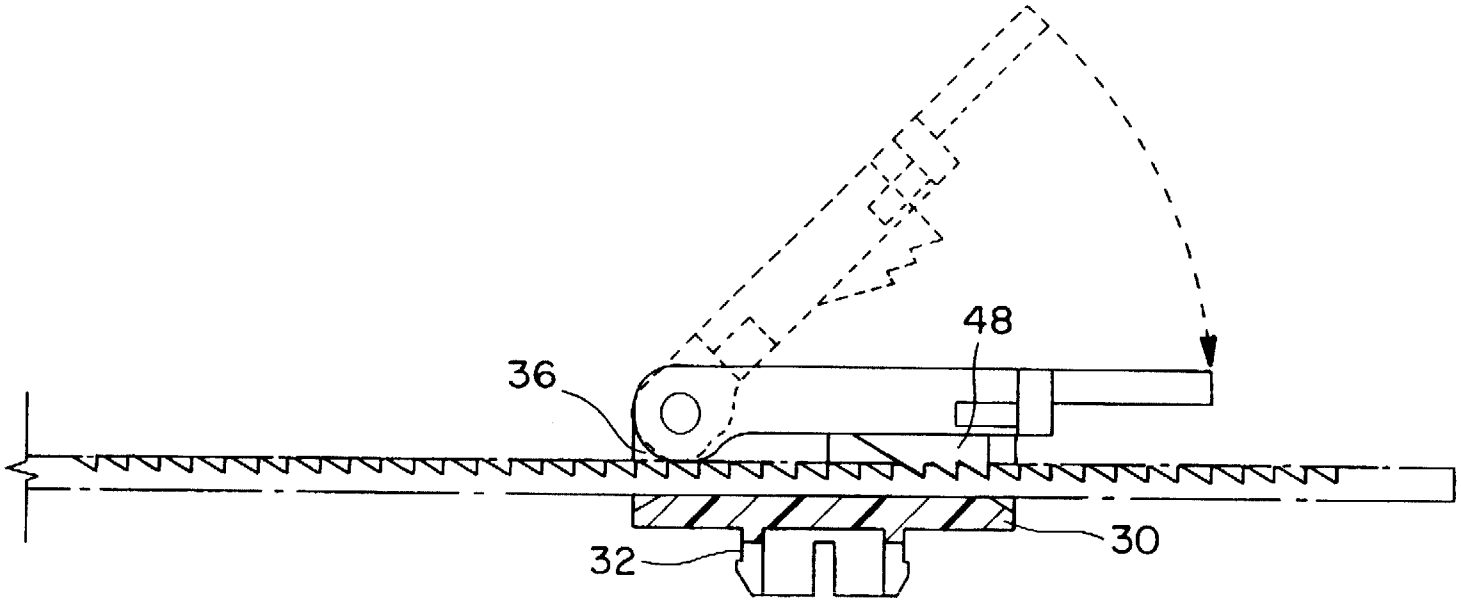
FIG. 4 is a side partially sectional view of FIG. 3.

Referring to FIG. 3, the strap assembly comprises a base assembly shown generally at 22 which includes a rear strap 24 which conforms to the rear of the helmet 10. In the center of the strap 24 is a snap fastener 26 which is adapted to rotatably engage the mating part of the snap assembly 18. Secured at the ends of the rear strap 24 are buckle tabs 27. Structurally, the buckle tabs 27 are mirror images of one another. The buckle tabs 27 comprise a pair of opposed walls **28*a* and 28*b* and a floor 30, see FIG. 4. The floor has a mounting post 32 which fixedly and rotatably secures the buckle tab 27 to the rear strap 24**.

The inner surfaces of the walls **28*a* and 28*b* each characterized by opposed guide rails 34*a* and 34*b*. The guide rails 34*a* and 34*b* are spaced apart from the outer surface of the floor 30 to define a slot 36 through which a strap will slide, as will be described. Above the guide rails 34*a* and formed in the wall 28*a* is a recess 38 (the other wall may be identical). A cover assembly is shown generally at 40 and includes a release tab 42 joined to a cover 44 which is pinned to the rear portion of the walls 28*a* and 28*b* at 46. The release tab 42 is enlarged with respect to the cover 44. It is wider than any other portion of the strap assembly 20. Further, the tabs 42 extend over the straps 60 defining an opening therebetween, see FIG. 4. This facilitates the tabs 42 being grasped easily by a crewman wearing gloves. A flexible pawl piece 48 is formed in the cover 44 and is defined by a U-shaped recess 50. The recess 50 allows the pawl 48 to be flexible with reference to the cover 44 as will be described. The cover assembly 40 is further characterized by a detent 52 which locks in the recess 38 in the wall 28*a***.

Straps **60*a* and 60*b* are shown which are mirror images of one another. Strap 60*a*, at one end, terminates in an enlarged cylindrical section 62*a* which section engages the prior art strut 12 of the helmet 10. The outer surface of the strap 60*a* is characterized by a ratchet track 64 which engages the pawl 48. The straps 60*a* and 60*b* are slidably received in the slots 36**.

When the cover assembly 40 is in its closed position with the detent 52 engaging the slot 38, the straps can move in the direction shown by the arrows and will stay locked in position to increase the pressure on the associated earcups.

With the cover assembly 40 in the open position, the crewman puts on the helmet and seats the earcups comfortably over the ears. The covers 44 are then closed to engage the teeth of the pawl 48 with the teeth of the ratchet track 64 on the straps. Then the crewman applies the desired amount of inward pressure on both earcups 14 with his/her hands. As the straps slide through the buckle tabs 40, the ratchet track 64 pushes the pawl 48 up to permit the straps one-way passage. As the teeth of the pawl 48 clear the teeth of the ratchet track 64, the pawl 48 snaps down and stops the strap from loosening by moving backwards. At any time if the crewman wants to snug the earcups further, more inward pressure is applied to the earcups. To loosen, the crewman simply opens the covers 40 to release the straps, closes them again and applies the desired pressure inward on the earcups.

The strap assembly 20 is mounted on the helmet with the pivoting snap fastener 26 located on the rear of the helmet shell. The buckle tabs 27 are mounted pivotally on the rear strap 24 with the post 32. This design then allows the strap assembly 20 to pivot sympathetically in two axis' (horizontal and pitch) as the crewman seats the helmet's earcups comfortably against the head. Adjustment in the third axis (vertical) is accomplished with slots in the helmet's struts that allow the forward ends of the straps to move up an down as needed.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described our invention, what I now claim is:

1. A strap assembly for controlling the inward pressure on earcups mounted on a helmet the assembly comprising:

a base assembly;

a pair of opposed tab buckles, the buckles defining a slot through which a strap may pass, the buckles each characterized by a flexible pawl formed in a cover adapted to move between an open and a closed position;

means to lock the cover into a closed position;

means for securing the base assembly to the helmet;

means for securing the tab buckles to the strap assembly;

a pair of straps each having one end securable to the forward portion of the helmet and another end, the straps adapted to engage earcups and configured to pass through the slots in the tab buckles, each of the straps characterized by a ratchet track whereby when the straps are moved toward one another to increase the inward pressure of the associated earcups, teeth on the ratchet track slide under and displace outwardly teeth on the pawl, which when the teeth on the ratchet track and the teeth on the pawl are locked together will prevent reverse movement of the strap when the cover is in its closed position.

2. The strap assembly of claim 1 wherein the means for securing the base assembly to the helmet comprises:

means for pivotally securing the base assembly to the helmet.

3. The strap assembly of claims 1 or 2 comprising:

means for pivotally securing the tab buckles to the base assembly.

* * * * *